US006474419B2

(12) United States Patent
Maier et al.

(10) Patent No.: US 6,474,419 B2
(45) Date of Patent: Nov. 5, 2002

(54) PACKER WITH EQUALIZING VALVE AND METHOD OF USE

(75) Inventors: Gary Maier, Calgary (CA); Marty L. Stromquist, Airdire (CA); Eric Schmelzl, Calgary (CA)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/411,774

(22) Filed: Oct. 4, 1999

(65) Prior Publication Data

US 2002/0062962 A1 May 30, 2002

(51) Int. Cl.[7] ..... E21B 23/06; E21B 33/12; E21B 34/06

(52) U.S. Cl. ..... 166/387; 166/127; 166/332.7; 166/334.1

(58) Field of Search ..... 166/118, 126, 166/128, 127, 332.1, 332.7, 334.1, 381, 387

(56) References Cited

U.S. PATENT DOCUMENTS 2,301,624 A * 10/1942 Holt ..... 166/100
3,306,366 A * 2/1967 Muse ..... 166/334.1
3,433,301 A * 3/1969 McEver, Jr. ..... 166/128
4,151,875 A * 5/1979 Sullaway ..... 166/126
5,456,322 A * 10/1995 Tucker et al. ..... 166/386

OTHER PUBLICATIONS

Halliburton Services Sales and Service Catalog No. 40, pp. 3486 and 3487 (Undated but admitted to be prior art).

* cited by examiner

*Primary Examiner*—David Bagnell
*Assistant Examiner*—Jennifer H Gay
(74) *Attorney, Agent, or Firm*—John W. Wustenberg; Robert A. Kent; Anthony L. Rahhal

(57) ABSTRACT

A packer with an equalizing valve for automatically equalizing the pressure above and below the packer element. The packer comprises a housing having an equalizing valve disposed therein. A packer element is disposed about the housing for sealingly engaging the wellbore. An equalizing valve is disposed in the housing and seals the housing to prevent flow therethrough when the packer element is actuated to engage the wellbore. The valve is movable in the closed position wherein communication through the housing is prevented to an open position so that the portion of the wellbore above the packer element may be communicated with a portion of the wellbore below the packer element while the element is in the set position so that pressure above and below the element may be equalized. Once the pressure is equalized, the packer can be unset and retrieved from the wellbore.

18 Claims, 9 Drawing Sheets

PACKER WITH EQUALIZING VALVE AND METHOD OF USE

BACKGROUND OF THE INVENTION

This invention relates to a packer apparatus for use in cased wellbores, and more specifically relates to a packer apparatus which will equalize the pressure above and below a packer element after the packer has been set, so that the packer may be easily disengaged from the wellbore or repositioned for additional use.

The use of different types of packers in wellbores to sealingly engage the wellbore or a casing in the wellbore is well known. There are a number of different types of packers, and packers are utilized for a number of different purposes. One type of packer utilizes a packer element which is compressed so that it will expand into and sealingly engage casing in a wellbore. Such packers are utilized for treating, fracturing, producing, injecting and for other purposes, and typically can be set by applying tension or compression to the work string on which the packer is carried. The packer can be utilized to isolate a section of the wellbore which may be either above or below the packer, depending on the operation to be performed.

Once a particular operation, for example fracturing a formation, has been performed, it may be desirable to unset or release the packer and move it to another location in the wellbore and set the packer again to isolate another section of the wellbore. Generally, a pressure differential across the packer element will exist after an operation in the wellbore is performed. For example, when fracturing fluid pumped through a work string is communicated with the wellbore adjacent a formation, the pressure above the packer element, which will be located below the formation, will be higher than the pressure below the packer element after the operation is performed. In order to unset the packer, the pressure above and below the packer element which engages the casing must be equalized. Normally, in order to equalize the pressure, the formation must be allowed to flow. If, because of the nature of the operation performed or due to the position of the packer, the pressure below a packer is greater than the pressure above the packer, pressure in the wellbore above the packer may be increased by displacing a higher or lower density fluid into the wellbore above the packer or by pressurizing the area above the packer. Once the pressure is equalized, the work string can then be manipulated to unset the packer.

There are a number of difficulties associated with the present methods of isolating formations utilizing packers lowered into a wellbore on coiled tubing. One manner of isolating sections is to utilize opposing cup packers which are well known in the art. To isolate a particular section of a wellbore, such a system utilizes upper and lower cup packers that are energized simply by flowing through a port between the packers which causes expansion of the packers by creating a differential pressure at the cups. Pressure may be equalized before attempting to move the packer by flowing the well back up the tubing. There are some difficulties associated with such a method, including leak-off and compression, and safety concerns because of the gasified fluids communicated to the surface. It is also sometimes necessary to reverse-circulate fluids to reduce the differential pressure used to set the cup packers. There are environments, however, where it is difficult to reverse-circulate. Although some opposing cup tools have a bypass which will allow the pressure above and below the tools to equalize, the bypasses cannot handle environments wherein fluids have a high solids content.

Although such a system may work adequately, compression packers are more reliable and create less wear on the coiled tubing. Compression packers utilized on coiled tubing to isolate a section of a wellbore typically have a solid bottom such that communication with the wellbore through the lower end of the packer is not possible and the only way to equalize pressure and unset the packer is by flowing the well or by pressurizing the wellbore. This presents many of the same problems associated with a dual cup packer system. If the tools are moved when differential pressure exists, damage may occur and such operations can be time-consuming and costly. Thus there is a need for a packer apparatus which can be repeatedly set and unset and moved within the wellbore without the need for flowing or pressurizing the wellbore to unset the packer.

There is also a need for such a packer apparatus which can be actuated primarily by reciprocation, so it can be effectively utilized on coiled tubing.

SUMMARY OF THE INVENTION

The present invention relates to a packer used for isolating formation in a wellbore. The packer has an equalizing valve which allows differential pressure across the packer element to be equalized after the packer has been set so that the packer can be easily unset and moved within the wellbore even in high solids environments.

The packer comprises a housing adapted to be connected in a work string lowered into the wellbore. The housing defines a longitudinal opening therethrough. An expandable packer element is disposed about the housing for sealingly engaging the wellbore, or the casing in the wellbore, below a desired formation which intersects the wellbore. The equalizing valve is disposed in the housing and is movable between an open and a closed position. In the open position, flow is allowed through the longitudinal opening in the housing through a lower end thereof into the wellbore. In the closed position, the equalizing valve seals the longitudinal opening so that flow through the housing is prevented. The valve moves to its closed position as the packer is actuated to set the packer element to sealingly engage the casing.

When the packer element sealingly engages the casing and the valve is in its closed position, the portion of the wellbore above the packer element is isolated from the portion of the wellbore therebelow. Thus, fluid may be displaced into the work string and through a port defined in the work string into the wellbore above the packer to perform a desired operation on the formation. If desired, the formation can be produced. When an operation requiring that fluid be displaced into the wellbore is performed, a pressure differential is created such that the pressure above the packer element exceeds that below the packer element. Once the desired operation is performed, it may be desirable to release the packer and to move the packer within the wellbore to another location to complete other operations or to retrieve the packer from the well. To unset the packer, the pressure above and below the packer element must be equalized before the packer can be moved or the tool string may be damaged. With the present invention, pressure is equalized by moving the valve from its closed to its open position, thereby unsealing the longitudinal opening in the housing and allowing the portion of the wellbore above the packer element to communicate with the portion of the wellbore below the packer element which will equalize the pressure above and below the element.

The packer housing includes a packer mandrel having a drag sleeve disposed thereabout. The packer element is disposed about the packer mandrel above the drag sleeve. The equalizing valve comprises a generally tubular element that is connected to a lower end of the drag sleeve and extends upwardly into the longitudinal opening defined by the packer mandrel and the drag sleeve. Communication is prevented by lowering the packer mandrel relative to the drag sleeve which is held in place by the casing in the wellbore. The valve will move upwardly relative to the mandrel until it engages a reduced diameter portion of the mandrel which effectively seals the opening and prevents flow therethrough. When it is desired to equalize pressure, upward pull is applied to the mandrel to allow flow therethrough and automatically equalize the pressure above and below the packer element.

BRIEF DESCRIPTION OF THE DRAWINGS

FIG. 6 shows a flat pattern of the J-slot defined in the packer mandrel of the present invention.

DETAILED DESCRIPTION OF A PREFERRED EMBODIMENT

Figure 1:
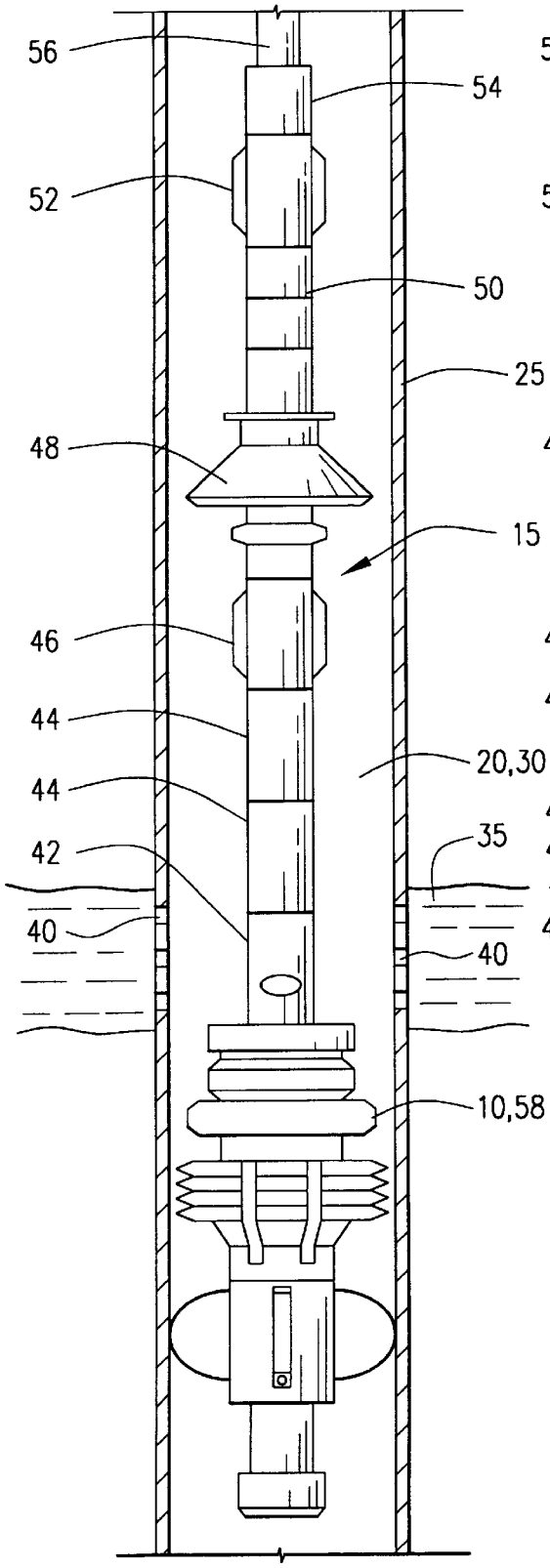
FIG. 1 shows the packer apparatus of the present invention disposed in a wellbore.
Figure 2:
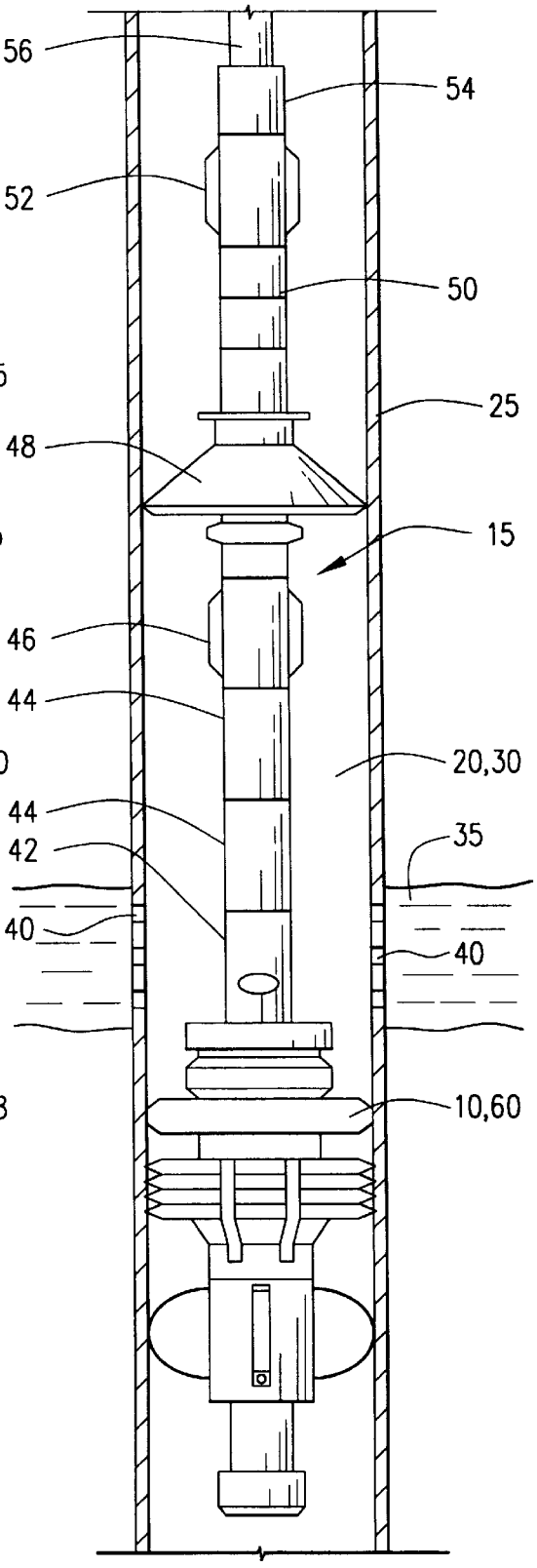
FIG. 2 schematically shows the packer apparatus set in a wellbore.
Figure 3A:
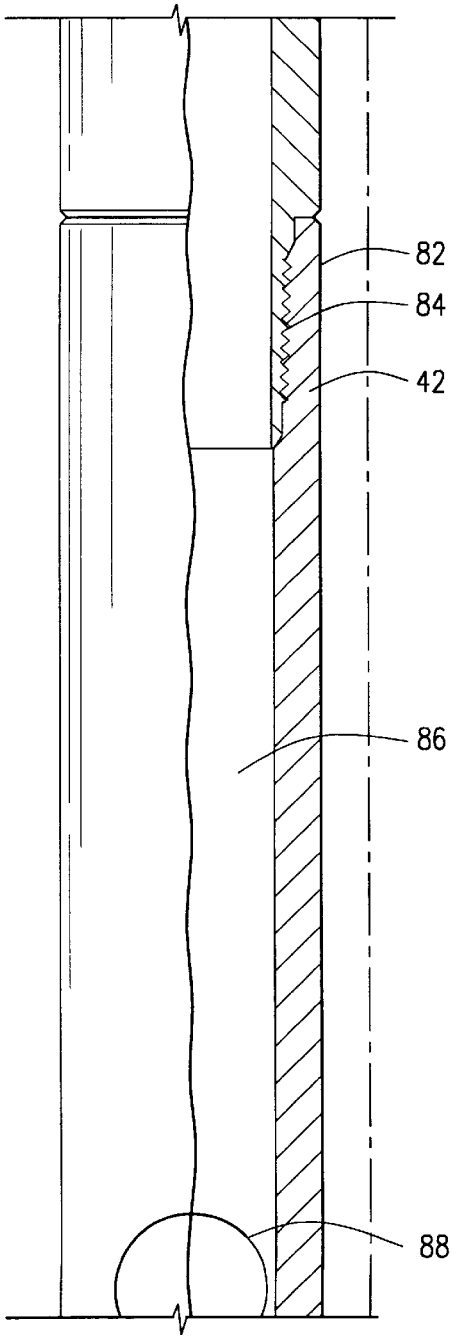
FIGS. 3A–3D are partial section views of the packer apparatus of the present invention in the running position.
Figure 3B:
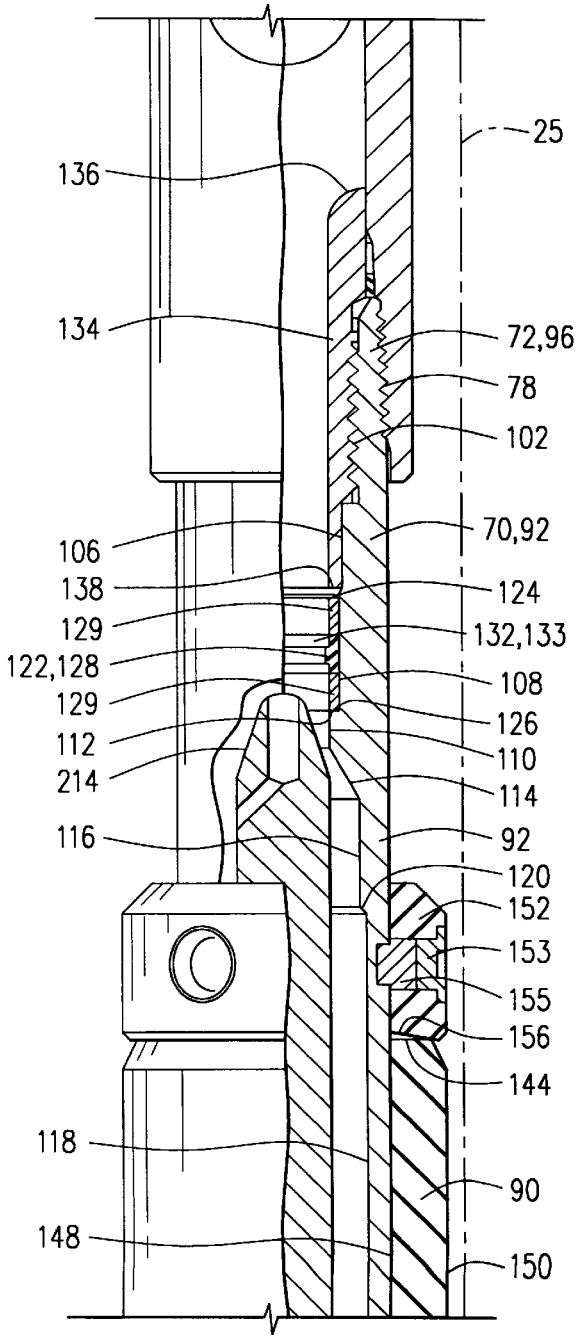
Figure 3C:
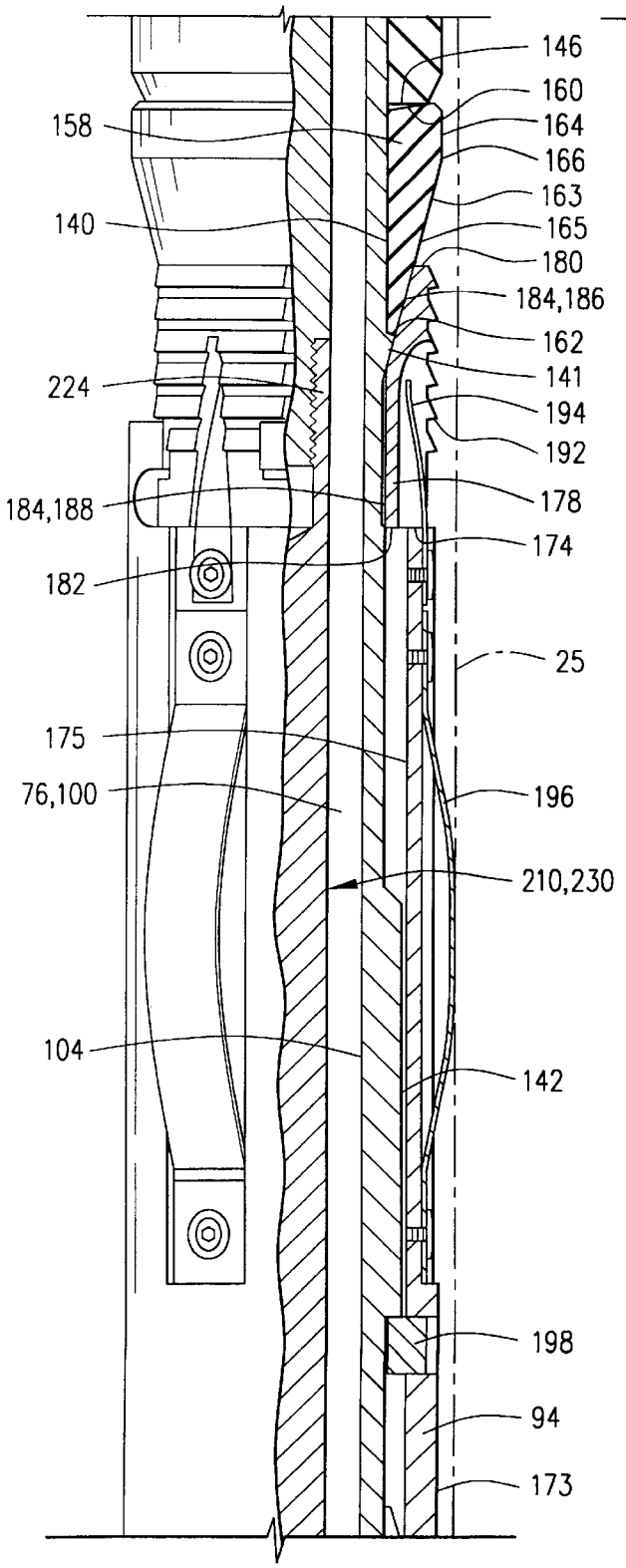
Figure 3D:
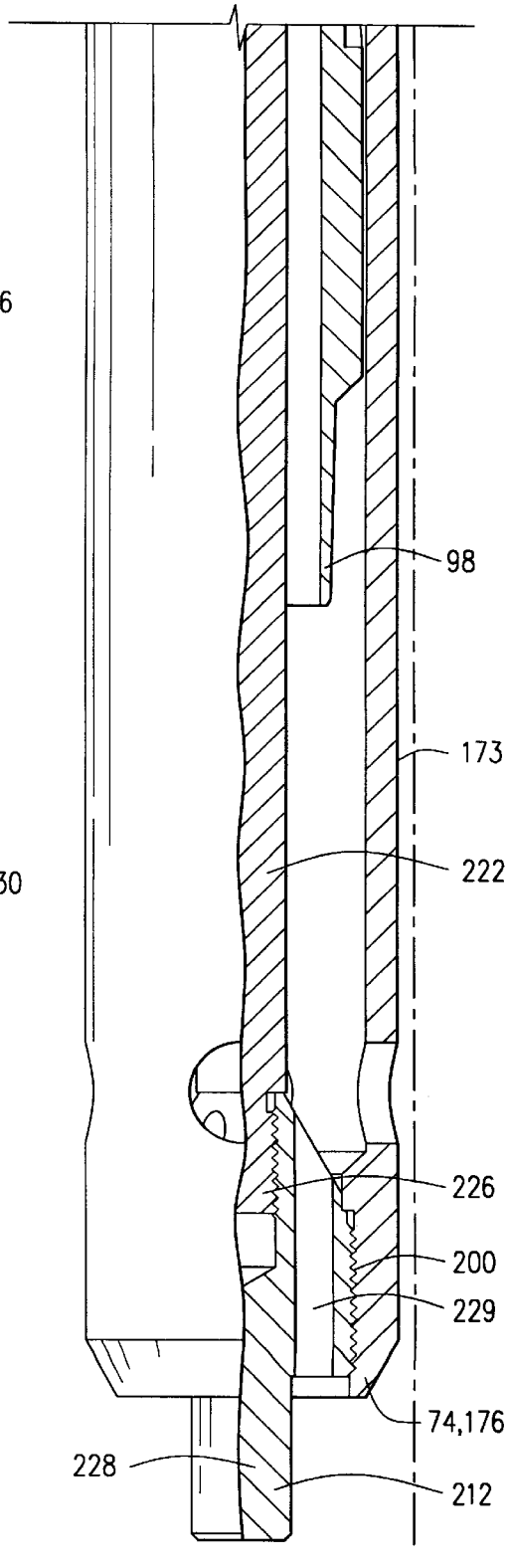
Figure 4A:
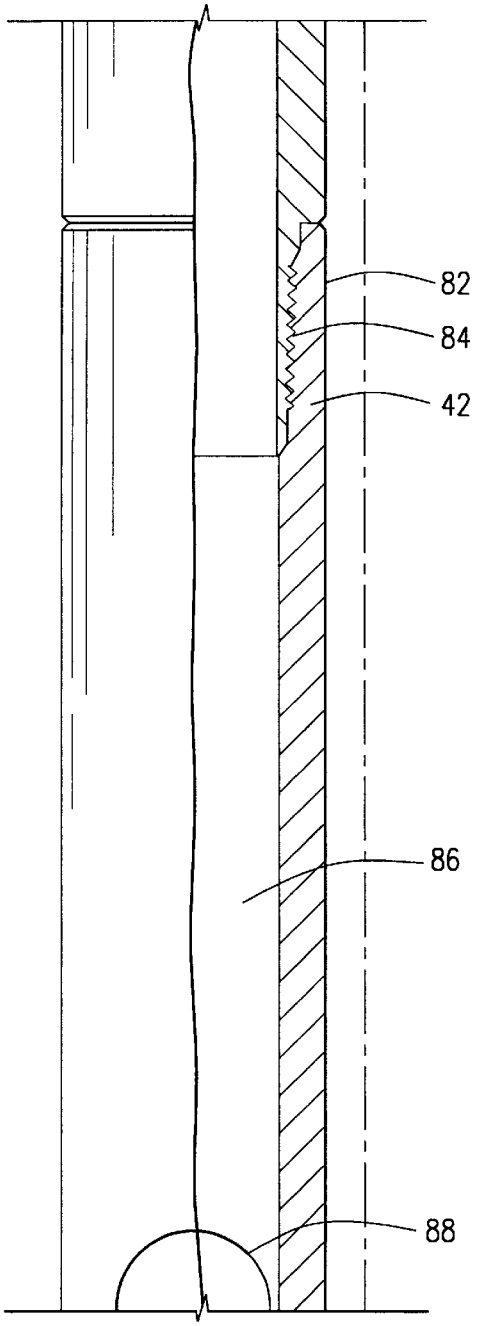
FIGS. 4A–4D are partial section views of the packer apparatus in the set position.
Figure 4B:
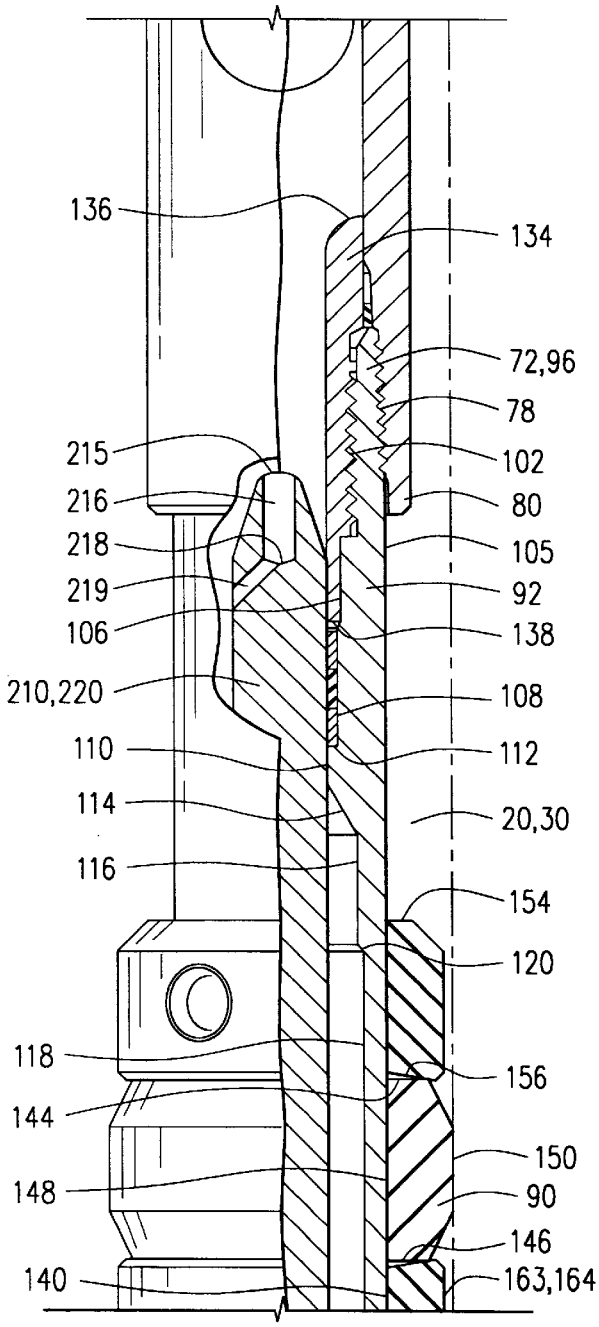
Figure 4C:
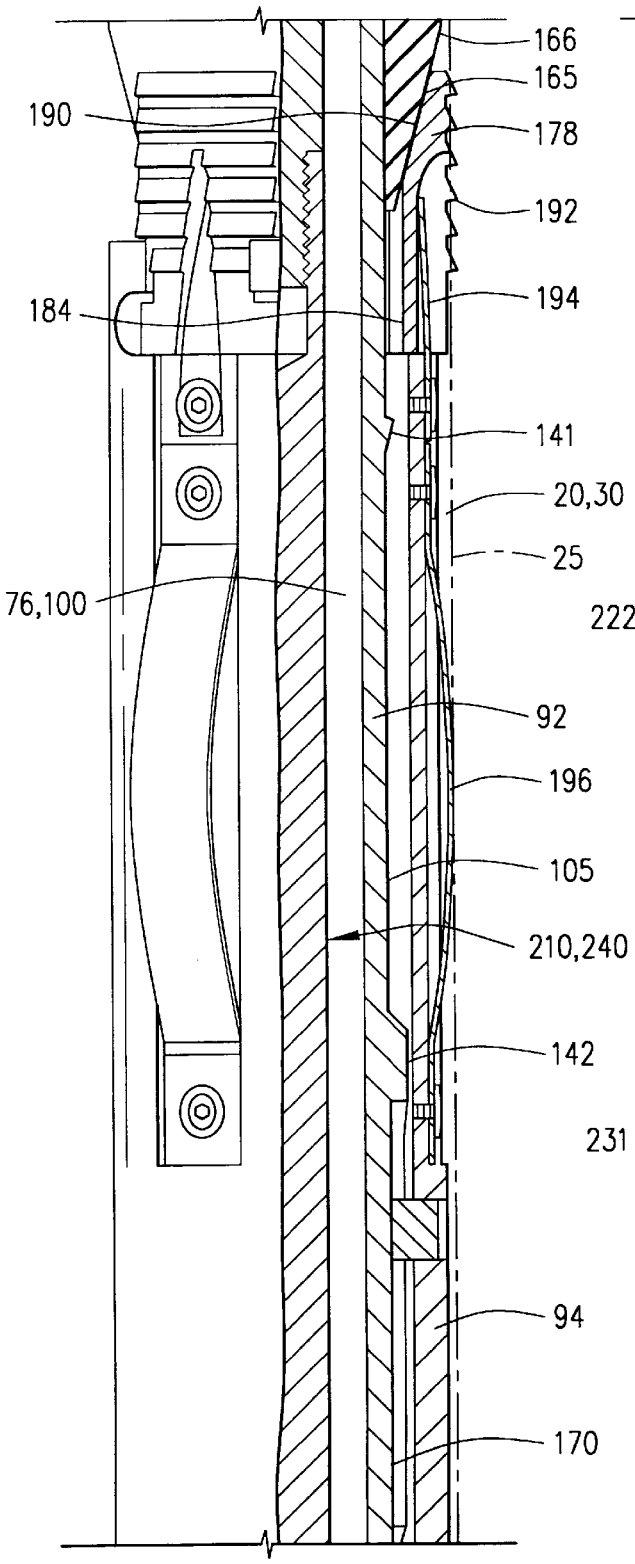
Figure 4D:
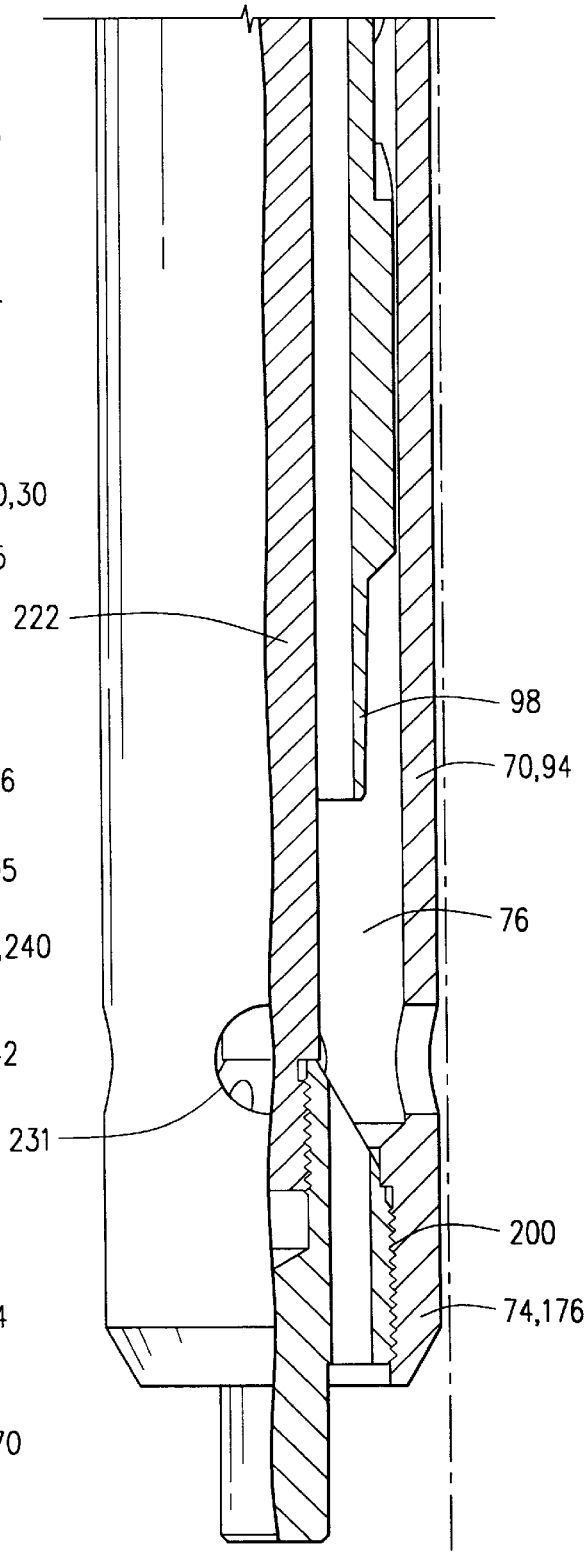
Figure 5A:
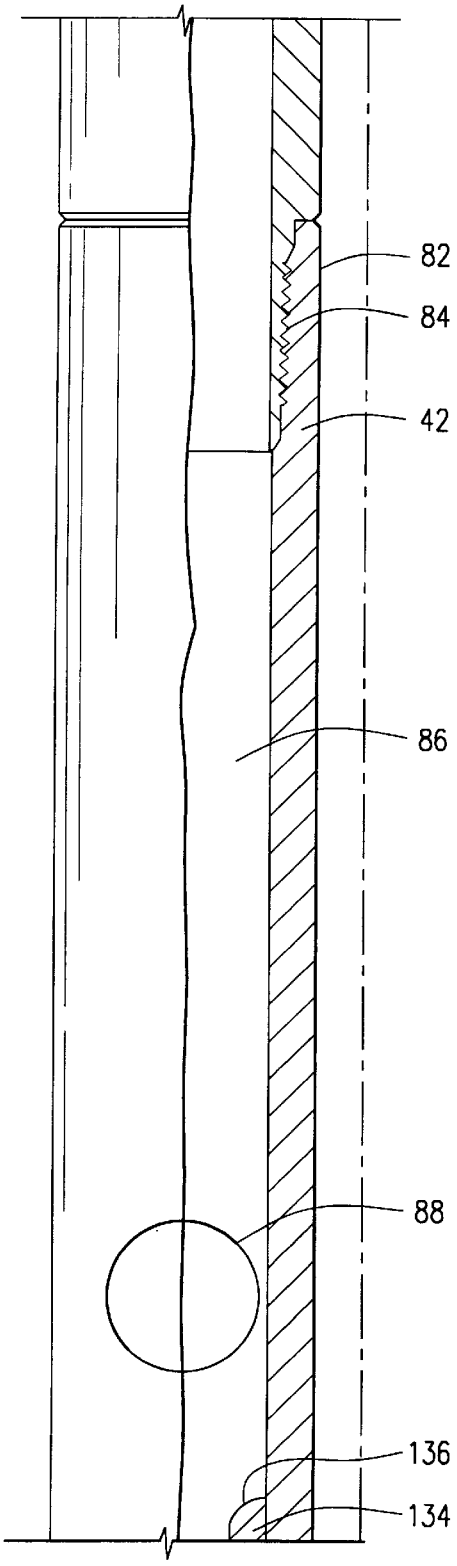
FIGS. 5A–5D are partial section views of the packer apparatus of the present invention in the retrieving position.
Figure 5B:
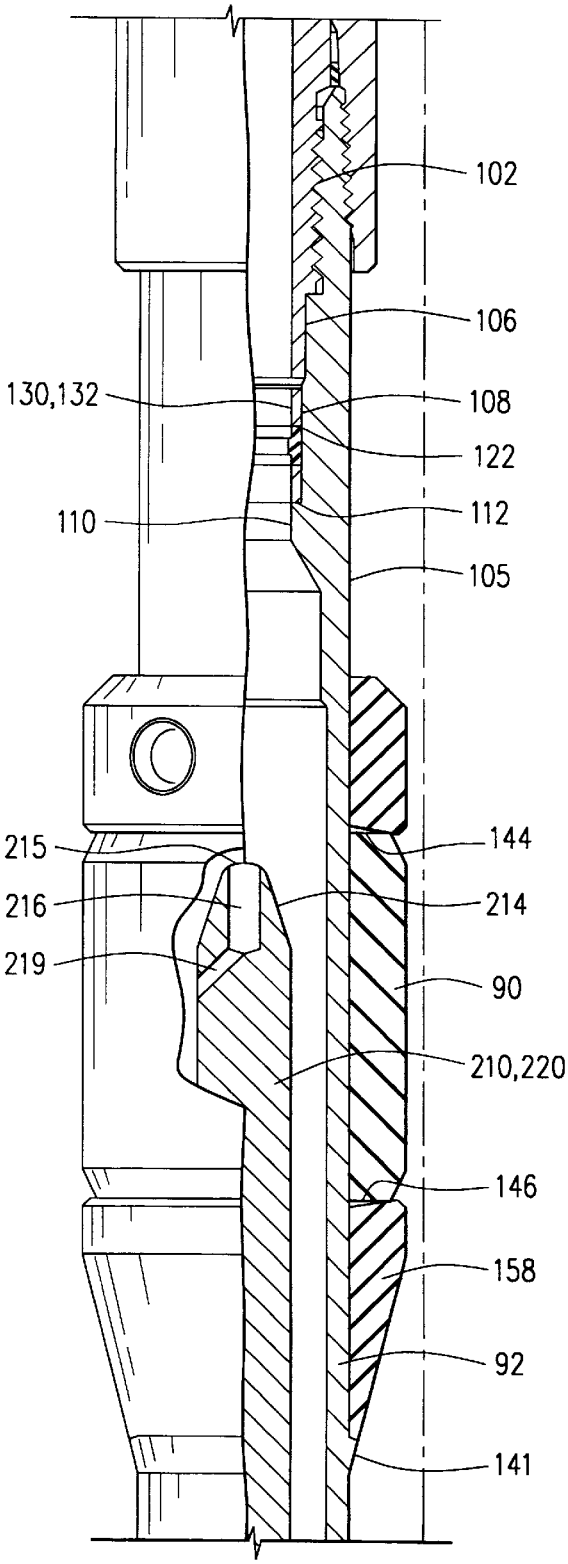
Figure 5C:
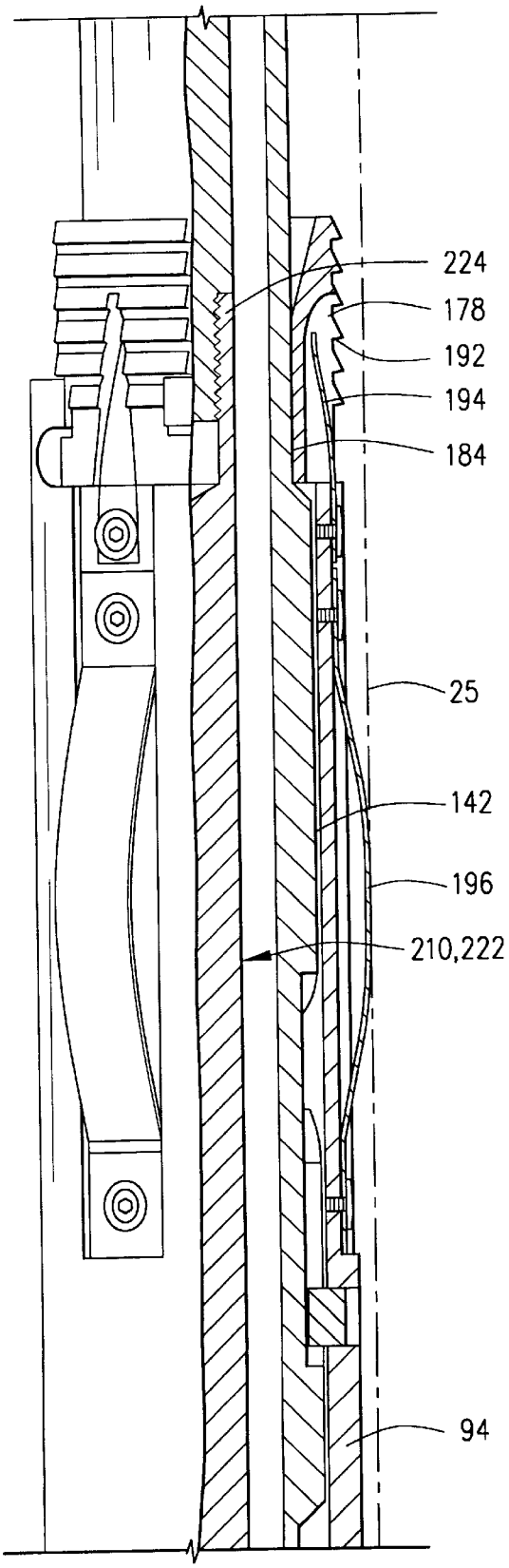
Figure 5D:
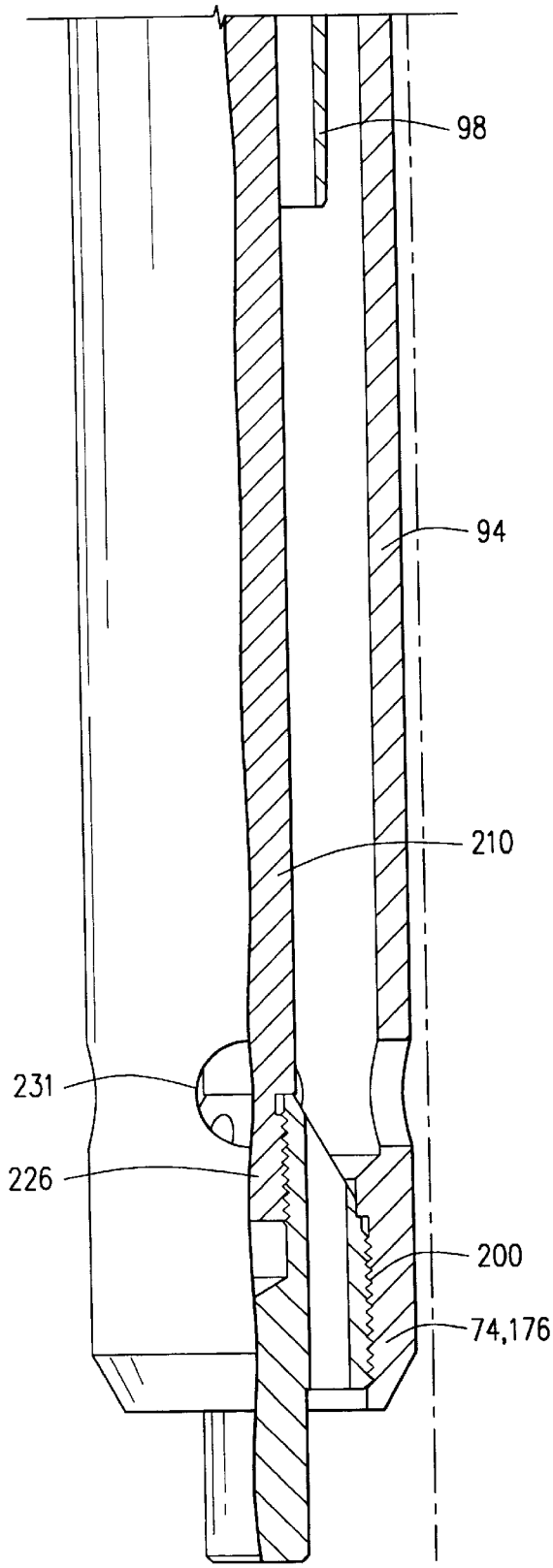
Figure 8:
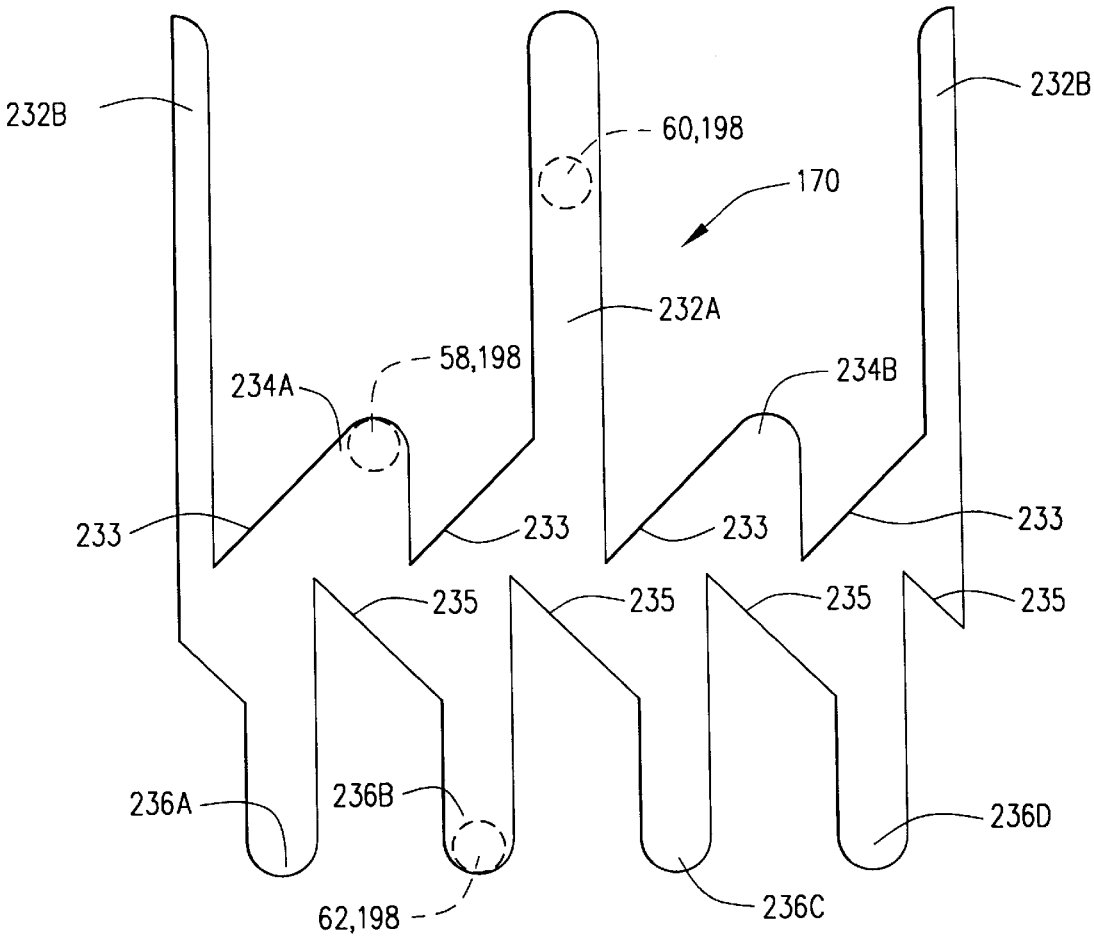

Referring now to the drawings and more particularly to FIGS. 1 and 2, a packer designated by the numeral 10 is shown connected in a work string 15 disposed in a wellbore 20. A casing 25 may be cemented in wellbore 20. An annulus 30 is defined by work string 15 and casing 25. As shown in FIGS. 1 and 2, wellbore 20 intersects a formation 35 which typically will be a hydrocarbon-containing formation. Casing 25 has perforations 40 adjacent formation 35 so that the formation is communicated with annulus 30.

In addition to packer 10, work string 15 may include a ported sub 42 connected to an upper end of packer 10, blast joints 44 connected to ported sub 42, a centralizer 46 and an upper packer 48 connected to centralizer 46. The upper packer 48 may have a shear release joint 50 connected to the upper end thereof. Upper packer 48 may have a second centralizer 52 connected thereto. Centralizer 52 has a coiled tubing connector 54 connected thereto which is adapted to be connected to coiled tubing 56. FIGS. 1 and 2 show the apparatus 10 lowered into wellbore 20 as part of the work string 15. Work string 15 is positioned so that packer 10 is positioned below formation 35 and packer 48, which may be a cup packer of the type known in the art, is positioned above formation 35. FIG. 1 schematically shows apparatus 10 in a running or unset position 58. FIG. 2 schematically shows packer 10 in its set position 60. Packer 10 is also shown in the running position 58 in FIGS. 3A–3D and in the set position 60 in FIGS. 4A–4D. Packer 10 is shown in FIGS. 5A–5D in a retrieving position 62. A casing 25 is depicted by a dashed line in each of FIGS. 3, 4 and 5.

Packer 10 comprises a housing 70 having an upper end 72 and a lower end 74. Housing 70 defines a longitudinal opening 76 extending from the upper end 72 to the lower end 74 thereof Housing 70 is connected at threaded connection 78 to a lower end 80 of ported sub 42. Ported sub 42 has an upper end 82 having threads 84 defined therein and is thus adapted to be connected in work string 15 between lower or first packer 10 and upper or second packer 48. Ported sub 42 defines an interior or longitudinal flow passage 86. Ported sub 42 also defines at least one and preferably a plurality of ports 88 defined therethrough intersecting flow passage 86 and thus communicating flow passage 86 with wellbore 20, and particularly with annulus 30.

Packer 10 further includes a packer element 90, which is preferably an elastomeric packer element disposed about housing 70. Housing 70 comprises a packer mandrel 92 having a drag sleeve 94 disposed thereabout. Packer element 90 is disposed about packer mandrel 92 above drag sleeve 94. Packer mandrel 92 has an upper end 96, a lower end 98 and defines a longitudinal opening 100 extending therebetween. Longitudinal opening 100 defines a portion of longitudinal opening 76. Threads 102 are defined in packer mandrel 92 at upper end 96 on an inner surface 104 thereof. Packer mandrel 92 further defines an outer surface 105.

Inner surface 104 of packer mandrel 92 defines a first inner diameter 106, a second inner diameter 108 therebelow and extending radially inwardly therefrom, and a third inner diameter 110 extending radially inwardly from second diameter 108. An upward facing shoulder 112 is defined by and extends between second and third inner diameters 108 and 110, respectively. Inner surface 104 further defines a tapered surface 114 extending downwardly and radially outwardly from third inner diameter 110 to a fourth inner diameter 116. A fifth inner diameter 118 has a magnitude greater than that of fourth inner diameter 116 and extends downwardly from a lower end 120 of fourth inner diameter 116 to lower end 98 of packer mandrel 92.

A seal 122 having an upper end 124 and a lower end 126 is disposed in packer mandrel 92 and is preferably received in second inner diameter 108. Seal 122 preferably includes an elastomeric seal element 128 and may have seal spacers 129 disposed in packer mandrel 92 to engage the upper and lower ends of seal element 128. Seal 122 has an inner surface 130 defining an inner diameter 132 which is preferably substantially identical to or slightly smaller than third inner diameter 110. Third inner diameter 110 and inner diameter 132 defined by seal 122 may be referred to as a reduced diameter portion 133 of packer mandrel 92 which, as explained in more detail below, will be sealingly engaged by the equalizing valve disposed in housing 70. A seal retainer 134 having an upper end 136 and a lower end 138 is threadedly connected to packer mandrel 92 at threads 102. Seal 122 is held in place by lower end 138 of seal retainer 134 and shoulder 112.

Outer surface 105 defines a first outer diameter 140 and a second outer diameter 142. A tapered shoulder 141 is defined on and extends radially outwardly from first outer diameter 140 above second outer diameter 142. Second outer diameter 142 extends radially outwardly from and has a greater diameter than first outer diameter 140.

Packer element 90 is disposed about outer surface 105, preferably about first outer diameter 140. Packer element 90 has an upper end 144, a lower end 146, an inner surface 148 and an outer surface 150. A packer shoe 152 having an upper end 154 and a lower end 156 is disposed about packer mandrel 92. Packer shoe 152 is connected to packer mandrel 92 with a screw 153 and shear pin 155, or by other means known in the art. Screw 153 and shear pin 155 are not shown in views 4A–4D and 5A–5D simply for clarity. Lower end 156 of packer shoe 152 engages upper end 144 of packer element 90.

A wedge 158 having an upper end 160 and a lower end 162 is disposed about outer surface 150 of packer mandrel 92. Upper end 160 of wedge 158 engages lower end 146 of packer element 90. Wedge 158 has an outer surface 163 which defines an outer diameter 164 which extends from the upper end 160 thereof a portion of the distance to lower end 162 and has a lower end 166. Outer surface 163 of wedge 158 tapers radially inwardly from lower end 166 of outer diameter 164 to lower end 162 of wedge 158 and comprises a tapered surface 165. When packer 10 is in running position 58, lower end 162 of wedge 158 engages radially outwardly extending tapered shoulder 141 on outer diameter 140 of packer mandrel 92.

Packer mandrel 92 defines a continuous J-slot 170 in the second outer diameter 142 thereof. J-slot 170 is shown in a flat pattern in FIG. 6, and will be explained in more detail hereinbelow. Drag sleeve 94 is disposed about packer mandrel 92 and along with packer mandrel 92 comprises housing 70. Drag sleeve 94 has an outer surface 173, an inner surface 175, an upper end 174 and a lower end 176 which extends downwardly beyond lower end 98 of packer mandrel 92, and comprises lower end 74 of housing 70. A slip 178 is disposed about packer mandrel 92 above drag sleeve 94. Slip 178 has an upper end 180 and a lower end 182. Lower end 182 engages upper end 174 of drag sleeve 94. An inner surface 184 of slip 178 has an upper portion 186 and a lower portion 188. Upper portion 186 of inner surface 184 is a tapered surface 190 that extends radially outwardly from packer mandrel 92 and is adapted to engage tapered surface 165 on wedge 158. Slip 178 is of a type well known in the art and has teeth 192 adapted to engage casing 25. Leaf springs 194 extend upwardly from upper end 174 of drag sleeve 94 and are adapted to engage slip 178 and to prevent slip 178 from prematurely engaging the casing. A plurality of drag springs 196 are attached to drag sleeve 94. Drag springs 196 extend radially outwardly from outer surface 173, and will engage casing 25 when packer 10 is in its running and retrieving positions 58 and 62, respectively. At least one, and preferably two lugs 198 are threadedly connected to drag sleeve 94 and extend radially inwardly from inner surface 175. Lug 198 extends into and is retained in J-slot 170 defined in packer mandrel 92.

Inner surface 175 of drag sleeve 94 has threads 200 defined thereon at the lower end 176 thereof. An equalizing valve 210 is threadedly connected to drag sleeve 94 at threads 200 and extends upwardly therefrom into packer mandrel 92. Equalizing valve 210 has a lower end 212 and extends upwardly in housing 70 to an upper end 214. Equalizing valve 210 is generally tubular and has a tapered upper end 214. Upper end 214 is a ported upper end and thus includes a generally vertical opening 216 extending downwardly from the tip 215 thereof. At least one and preferably a plurality of radial ports 219 extend radially outwardly from the lower end 218 of vertical opening 216 through the side of equalizing valve 210.

Equalizing valve 210 may be made up in sections which include ported valve tip 220 which is threadedly connected to a valve extension 222 having upper and lower ends 224 and 226, respectively. A valve bypass insert 228 is threadedly connected to valve extension 222. Valve bypass insert 228 is threadedly connected to threads 200 on drag sleeve 94. Valve bypass insert 228 has a plurality of passageways 229 therethrough to provide for the communication of fluid therethrough.

The operation of packer 10 may be described as follows. Packer 10 is lowered into wellbore 20 as schematically depicted in FIG. 1 on work string 15. Drilling fluid or other fluid in the wellbore 20 may be communicated through valve bypass insert 228 into the housing and upward into ported sub 42. Fluid in the wellbore 20 is also communicated through ports 88 in ported sub 42. Running position 58 may also be referred to as an open position of the packer 10 since communication of fluid through housing 70 is permitted. Thus, when packer 10 is in running position 58, equalizing valve 210 may also be said to be in an open position, which may be referred to as a first open position 230. Packer 10 is lowered into the wellbore 20 until it reaches a desired location in the wellbore 20, such as that schematically depicted in FIG. 1. As shown therein, packer apparatus 10 is located below formation 35 and upper packer 48 is located above formation 35 in which an operation is to be performed. The operation may be production, treatment, fracturing or other desired operation.

As packer 10 is lowered into the wellbore 20, J-slot 170 will engage lug 198 such that drag sleeve 94 moves downward with packer mandrel 92. This is more easily seen in FIG. 6. As shown therein, J-slot 170 has two packer set legs 232A and 232B, respectively, two packer run legs 234A and 234B, respectively and four packer retrieve legs 236A, 236B, 236C and 236D, respectively.

J-slot 170 also includes upper ramps 233 extending between the packer set legs 232A–232B and the packer run legs 234A–234B and has lower ramps 235 extending between adjacent packer retrieve legs 236A–236D. When packer 10 is being lowered into the wellbore 20, lug 198 will engage one of packer run legs 234A–234B and in FIG. 6 is shown engaging an upper end of packer set leg 234A. When the packer 10 has reached its desired location, the work string may be lifted upwardly to move packer 10 from its running position 58 to its set position 60. Upward pull on coiled tubing 56 will cause packer mandrel 92 to move upward relative to drag sleeve 94 which will be held in place by the engagement of drag springs 196 with casing 25. Lug 198 will engage a lower ramp 235 which will cause rotation of drag sleeve 94 relative to packer mandrel 92. Pull is continued until lug 198 is positioned over a retrieving leg 236A–236D, and in FIG. 6, over leg 236B. Coiled tubing 56 may then be released and allowed to move downwardly so that packer mandrel 92 moves downwardly relative to drag sleeve 94 and thus downward relative to equalizing valve 210. Slip 178 is urged radially outwardly by wedge 158 to engage casing 25. When slip 178 engages casing 25, downward movement of wedge 158 stops. Packer shoe 152 will continue to move with packer mandrel 92 and will compress packer element 90 so that it sealingly engages casing 25. Lug 198 will engage an upper ramp 233, and as packer mandrel 92 continues to be lowered, drag sleeve 94 will rotate and lug 198 will be received in a packer set leg 232A–232B, in this case leg 232A until it reaches the set position 60. When packer 10 is moved to its set position 60, which may also be referred to as a closed position of the packer 10, equalizing valve 210 moves upward relative to packer mandrel 92 to a closed position 240 such that it engages reduced diameter portion 133 and is sealingly engaged by seal 122. Equalizing valve 210 thus moves to closed position 240 when the packer 10 is actuated to its set position 60 wherein packer element 90 sealingly engages casing 25 below formation 35.

When the equalizing valve 210 is in closed position 240, it seals longitudinal opening 76 such that communication through housing 70 is blocked. Thus, fluid may be displaced down coiled tubing 56 and through ports 88 to treat formation 35, or the formation 35 may be produced through ports 88. For example, if the formation 35 is to be fractured, fracturing fluid may be displaced down coiled tubing 56 and out ports 88 into annulus 30 and formation 35. Displacement of fluid into annulus 30 through ports 88 will energize upper packer 48 so that it seals against casing 25 above formation 35. Pressure above packer element 90 will increase as fracturing fluid is continually displaced through ports 88 into the annulus 30 between packer element 90 and upper packer 48.

Once the desired operation, in this case fracturing, is complete, it will be desirable to either remove work string 15 from wellbore 20 or to move the work string 15 within the wellbore 20 to perform another operation at a different location within the wellbore 20. In order to do so, it is necessary to equalize pressure above and below the packer element 90.

To equalize the pressure, upward pull is once again applied to packer mandrel 92 by pulling upwardly on coiled tubing 56. Packer mandrel 92 will move relative to equalizing valve 210 until radial ports 219 are below seal 122. This will allow fluid in wellbore 20 between packers 10 and 48 to pass through ports 88 into longitudinal opening 76 defined by housing 70, and out through valve bypass insert 228 into the wellbore 20 below packer element 90. As pressure begins to equalize, upward pull on coiled tubing 56 will become easier and a greater flow area will be established when equalizing valve 210 is completely removed from reduced diameter portion 133 such that free communication is allowed from wellbore 20 into ports 88 and downward through housing 70. Because free communication is allowed, pressure will equalize and the packer 10 can be easily unset simply by continuing to pull upwardly on packer mandrel 92 with coiled tubing 56. Because there will be little or no differential pressure across packer element 90, upward pull will allow the packer 10 to unset. The packer 10 can be pulled upwardly and retrieved, as depicted in FIGS. 5A–5D or if desired can be moved to another location in the wellbore 20 and can be reset so that treatment and/or production from another formation can occur. This process can be repeated as often as possible in individual formations in the wellbore 20.

In the embodiment shown, lugs 198 are fixed to drag sleeve 94. Thus, drag sleeve 94 will rotate when packer mandrel 92 is moved vertically such that ramp 233 or 235, respectively, is engaged by lugs 198. An alternate lug arrangement is shown in FIG. 7.

Figure 7:
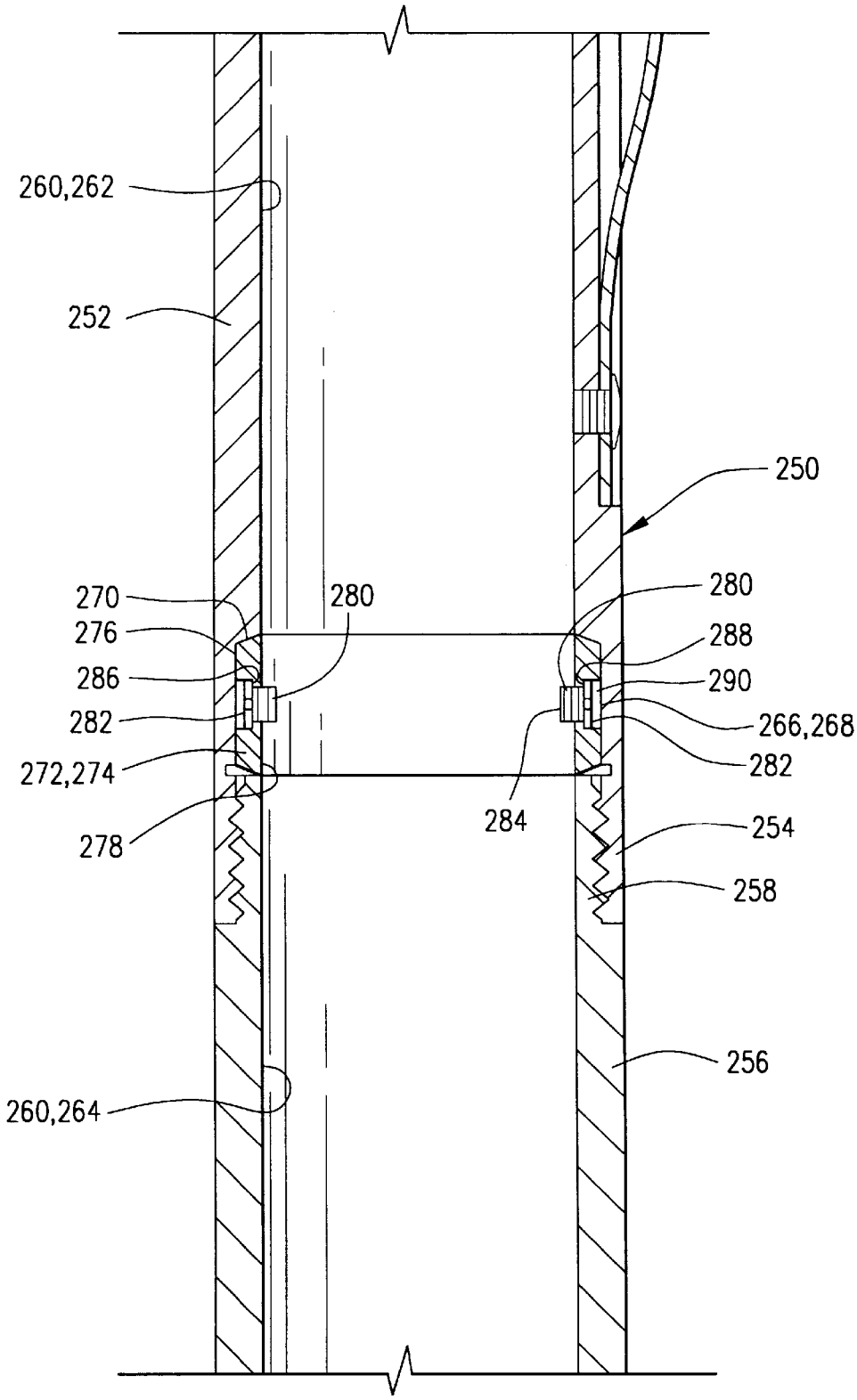
FIG. 7 shows an alternative embodiment of a drag sleeve of the present invention.

FIG. 7 shows a drag sleeve 250. Drag sleeve 250 is identical in all aspects to drag sleeve 94 except that drag sleeve 250 is comprised of two pieces and includes a rotatable ring with lugs attached thereto as will be described. Drag sleeve 250, like drag sleeve 94, has drag springs 196 and has ports 231, along with the other features of drag sleeve 94. Drag sleeve 250 comprises an upper portion 252 having a lower end 254, and a lower portion 256 having an upper end 258. Drag sleeve 250 has an inner surface 260 which defines an inner diameter 262 on upper portion 252 and an inner diameter 264 on lower portion 256. Drag sleeve 250 has a recess 266 defined therein defining a recessed diameter 268, which is recessed outwardly from inner diameter 262. Recess 266 defines a downward facing shoulder 270 in upper portion 252.

A lug rotator assembly 272 is disposed in drag sleeve 250 in recess 266 and is rotatable therein. The lug rotator assembly 272 comprises a rotator ring 274 having an outer diameter 276 and an inner diameter 278. Outer diameter 276 is preferably slightly smaller than recessed diameter 268 so that rotator ring 274 will rotate in recess 266. Inner diameter 278 is preferably substantially the same as inner diameter 262. Lug rotator assembly 272 includes a pair of lugs 280 extending radially inwardly from inner diameter 278. Lugs 280 are adapted to be received in J-slot 170. Lugs 280 may have a generally cylindrical shaft portion 282 and a head 284. Head 284 defines a shoulder 286 and will engage an opposite facing shoulder 288 defined in rotator ring 274 in openings 290 in which lugs 280 are received. Lug rotator assembly 272 is held in place by downward facing shoulder 270 and upper end 258 of lower portion 256 of drag sleeve 250. Lug rotator assembly 272 will rotate relative to drag sleeve 250 when packer mandrel 92 is moved therein such that lugs 280 engage either the upper ramp 233 or the lower ramp 235 defined by the J-slot 170. Vertical movement of the packer mandrel 92 after lugs 280 have engaged a ramp will cause lug rotator assembly 272 to rotate until the lugs 280 are positioned in a packer run leg, a packer set leg, or a packer retrieve leg depending on the operation to be performed. This insures an apparatus that can be moved between its set and unset positions, even in wellbores where drag sleeves tightly engage the casing such that the drag sleeve will not readily rotate to allow lugs fixed thereto to be moved within the J-slot to a desired position.

Although the invention has been described with reference to a specific embodiment, and with reference to a specific operation, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed within the scope of the invention.

What is claimed is:

1. A retrievable packer apparatus for isolating a subsurface formation intersected by a wellbore, the packer apparatus comprising:

a packer mandrel adapted to be connected in a work string and lowered into the wellbore, the packer mandrel defining a longitudinal opening therethrough;

a drag sleeve disposed about the packer mandrel, the drag sleeve being slidable relative to the packer mandrel;

an expandable packer element disposed about the packer mandrel, the packer apparatus having a set position wherein the packer element seals the wellbore and an unset position wherein the packer element does not seal the wellbore, wherein the packer apparatus may be alternated in the wellbore between the set and unset positions; and an equalizing valve connected to a lower end of the drag sleeve and extending upwardly therefrom into the packer mandrel, the equalizing valve having an open position and a closed position, wherein in the closed position the equalizing valve seals the longitudinal opening to prevent communication through the packer mandrel so that a portion of the wellbore above the packer element will be isolated from a portion of the wellbore below the packer element when the packer apparatus is in the set position, and wherein the portion of the wellbore above the packer element may be communicated with the portion of the wellbore below the packer element through the packer mandrel when the equalizing valve is in the open position so that the pressure above and below the packer element is equalized;

wherein the packer mandrel may be moved vertically relative to the drag sleeve to move the equalizing valve between the open and closed positions.

2. The retrievable packer apparatus of claim 1, wherein the equalizing valve may be moved between the open and closed positions by reciprocation of the work string.

3. The retrievable packer apparatus of claim 1, wherein the equalizing valve defines a generally cylindrical outer surface, and wherein in the closed position the generally cylindrical outer surface sealingly engages an inner surface of the packer mandrel.

4. The retrievable packer apparatus of claim 1, wherein an interior of the work string is in communication with the wellbore through flow ports defined in the work string above the packer element so that a fluid may be communicated into the formation through the flow ports when the equalizing valve is in the closed position, and wherein the portion of the wellbore above the packer element is in communication with the portion of the wellbore below the packer element through the flow ports, the packer mandrel, and the drag sleeve into the wellbore when the equalizing valve is in the open position in order to equalize the pressure in the wellbore above and below the packer element.

5. The retrievable packer apparatus of claim 1, wherein the equalizing valve moves from the open position to the closed position when the packer apparatus is actuated to expand the packer element to sealingly engage the wellbore.

6. The retrievable packer apparatus of claim 1, wherein the longitudinal opening has a reduced diameter portion, wherein the equalizing valve comprises a generally tubular element disposed in the longitudinal opening, and wherein the equalizing valve is moved between the open and closed positions by moving the equalizing valve in and out of the reduced diameter portion to seal and open the longitudinal opening.

7. The retrievable packer apparatus of claim 1, wherein the equalizing valve moves between the open and the closed positions as the packer apparatus is moved between the set and unset positions.

8. The retrievable packer apparatus of claim 1, wherein the equalizing valve may be moved from the closed position to the open position by pulling upward on the work string.

9. An apparatus for use in a wellbore to isolate a formation intersected by the wellbore, the wellbore having casing therein, the apparatus comprising:

an upper packer connected in a work string for sealingly engaging the casing above the formation; and a lower packer movable between a set and an unset position in the wellbore connected in the work string below the upper packer, the lower packer comprising:

a packer mandrel having an upper end and a lower end, the packer mandrel defining a longitudinal opening extending from the upper end to the lower end thereof;

a packer element disposed about the packer mandrel for sealingly engaging the casing below the formation in the set position of the lower packer, the work string defining a flow port therethrough between the upper and lower packers for communicating an interior of the work string with the wellbore;

a drag sleeve disposed about the packer mandrel and movable relative thereto; and a valve connected to a lower end of the drag sleeve and extending upwardly therefrom into the packer mandrel, the valve having a closed position for sealing the longitudinal opening defined by the packer mandrel to prevent communication therethrough when the packer element sealingly engages the casing, and having an open position wherein the wellbore above the packer element is communicated with the wellbore below the packer element through the flow port and the lower packer to equalize pressure above and below the lower packer and allow the lower packer to be moved to the unset position.

10. The apparatus of claim 9, wherein the valve may be moved between the open and closed positions by reciprocating the packer mandrel in the wellbore.

11. The apparatus of claim 9, wherein the valve moves to the closed position when the packer element is expanded to sealingly engage the casing so that the portion of the wellbore above the packer element is isolated from the portion of the wellbore below the packer element.

12. The apparatus of claim 11, wherein the valve comprises a generally tubular element extending upwardly from the lower end of the drag sleeve and the longitudinal opening has a reduced diameter portion, wherein the reduced diameter portion is adapted to sealingly engage the valve to seal the longitudinal opening and wherein the packer mandrel moves vertically relative to the valve to selectively move the valve in and out of the reduced diameter portion between the closed and open positions.

13. The apparatus of claim 9, wherein the valve sealingly engages the longitudinal opening at a location adjacent or above the packer element.

14. The apparatus of claim 9, wherein the valve may be moved from the closed position to the open position by pulling upward on the work string.

15. A method of treating a subsurface formation intersected by a wellbore comprising:

lowering a work string having a first packer apparatus connected to a lower end of the work string to a desired location in the wellbore, the work string being communicated with the wellbore through a longitudinal opening defined by the first packer apparatus, the first packer apparatus comprising:

a packer mandrel; and an expandable packer element disposed about the packer mandrel;

compressing the expandable packer element by lowering the packer mandrel relative to the expandable packer element thereby expanding the packer element outward to engage and seal a casing in the wellbore below the formation, wherein the compressing step seals the longitudinal opening to prevent communication therethrough;

displacing a fluid down the work string and into the wellbore through a flow port defined in the work string above the first packer apparatus;

unsealing the longitudinal opening after the displacing step to communicate a portion of the wellbore above the expandable packer element with a portion of the wellbore below the expandable packer element through the longitudinal opening to equalize a pressure in the wellbore above and below the expandable packer element; and disengaging the expandable packer element from the casing.

16. The method of claim 15, wherein the work string has a second packer apparatus connected therein, the second packer apparatus being located above the formation, the method further comprising:

actuating the second packer apparatus to seal the wellbore above the formation.

17. The method of claim 15 further comprising:

moving the work string to a second desired location in the wellbore;

compressing the expandable packer element by lowering the packer mandrel relative to the expandable packer element to seal the casing and seal the longitudinal opening in the first packer apparatus after the moving step;

displacing a second fluid down the work string into the wellbore above the first packer apparatus; and reopening the longitudinal opening to equalize the pressure above and below the expandable packer element of the first packer apparatus after the step of displacing a second fluid down the work string.

18. The method of claim 15, wherein the first packer apparatus further comprises:

a drag sleeve disposed about the packer mandrel, the drag sleeve being slidable relative to the packer mandrel; and an equalizing valve connected to a lower end of the drag sleeve and extending upwardly therefrom into the packer mandrel.

* * * * *